US006494537B1

(12) United States Patent
Lie

(10) Patent No.: US 6,494,537 B1
(45) Date of Patent: Dec. 17, 2002

(54) CHAIR MECHANISM

(75) Inventor: Tore Lie, Moelv (NO)

(73) Assignee: Ring Holding AS, Ringsaker (NO)

( * ) Notice: Subject to any disclaimer, the term of this patent is extended or adjusted under 35 U.S.C. 154(b) by 0 days.

(21) Appl. No.: 09/701,932

(22) PCT Filed: Jun. 16, 1999

(86) PCT No.: PCT/NO99/00196

§ 371 (c)(1),
(2), (4) Date: Dec. 5, 2000

(87) PCT Pub. No.: WO99/65365

PCT Pub. Date: Dec. 23, 1999

(30) Foreign Application Priority Data

Jun. 17, 1998 (NO) ..... 982788

(51) Int. Cl.[7] ..... A47C 1/032
(52) U.S. Cl. ..... 297/300.4; 297/301.3
(58) Field of Search ..... 297/300.4, 301.3, 297/302.3, 303.3

(56) References Cited

U.S. PATENT DOCUMENTS 2,935,119 A * 5/1960 Lie ..... 297/303.3
3,027,191 A * 3/1962 Lie ..... 297/302.3
3,868,144 A * 2/1975 Lie ..... 297/300.4
4,235,408 A * 11/1980 Sapper ..... 297/303.3
5,209,548 A * 5/1993 Locher ..... 297/300.4

* cited by examiner

*Primary Examiner*—Peter R. Brown
(74) *Attorney, Agent, or Firm*—Pitney, Hardin, Kipp & Szuch LLP

(57) ABSTRACT

Chair mechanism especially for office chairs and larger arm chairs, characterized in one end of a torsion spring (1); being fixedly connected with one end of an inner pipe (3) being turnably supported in a pipe (4), the other end being supported turnably in an outer pipe (2) which again is secured to the other end of the spring (1), the outer pipe (2) and the pipe (4) being fixedly connected with each other through an angle profile (12) securing a fixed connection between the outer pipe (2), the pipe (4), the angle profile (12), the seat (13) of the chair and the two back supports (10, 11) of the chair which are secured at a distance from each other to respectively the outer pipe (2) or the pipe (4), a pressure arm (8) being connected with a centre portion of the inner pipe (3) between the pipe (4) and the outer pipe (2) and the pressure arm (8) abutting with a prestress against a bow mechanism (5) connected to the fundament of the chair and adjustable by means of a screw (9).

1 Claim, 2 Drawing Sheets

CHAIR MECHANISM

The present invention is related to a chair mechanism, especially for office chairs and larger arm chairs.

The tendency in the development of especially office chairs is office chairs having higher and broader backs. In this connection the demand arises for a stronger securement of the back to the chair mechanism below the seat than the case is for usually used chair mechanisms of today.

With the chair mechanism according to the present invention a mechanism is provided where a wide and high back is securely supported as the back is secured with two back supports arranged at a distance from each other, as opposed to the normal design for such chairs where only one back support is connected with the mechanism. This is achieved with the mechanism according to the present invention as defined with the features stated in the claims.

Figure 1:
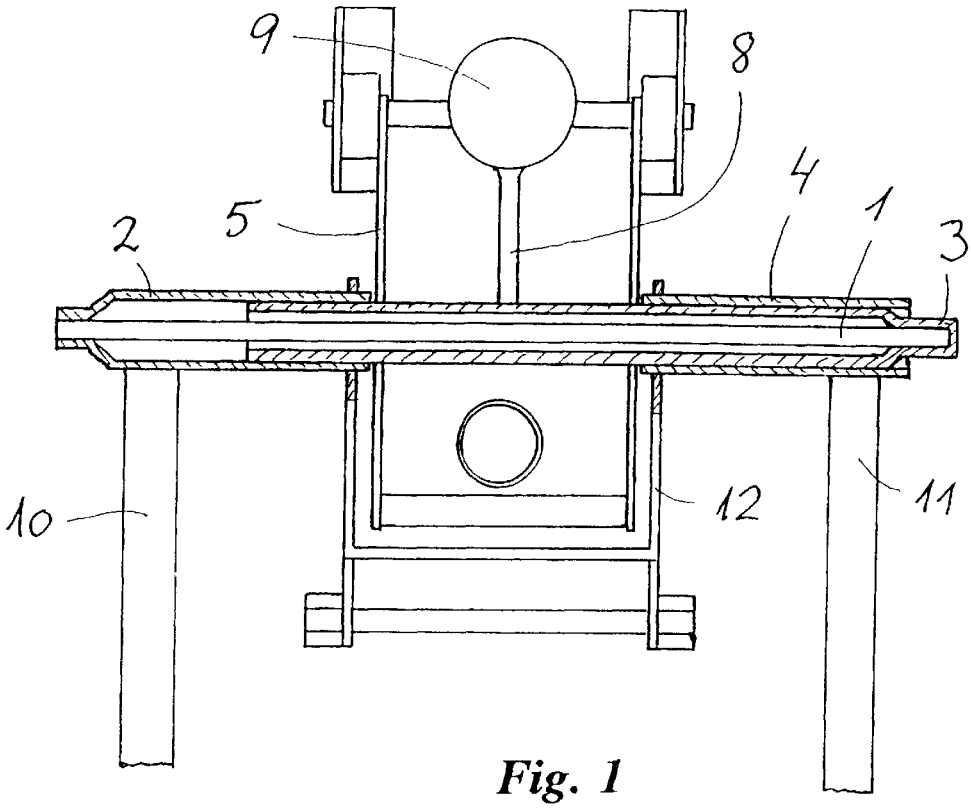
Figure 2:
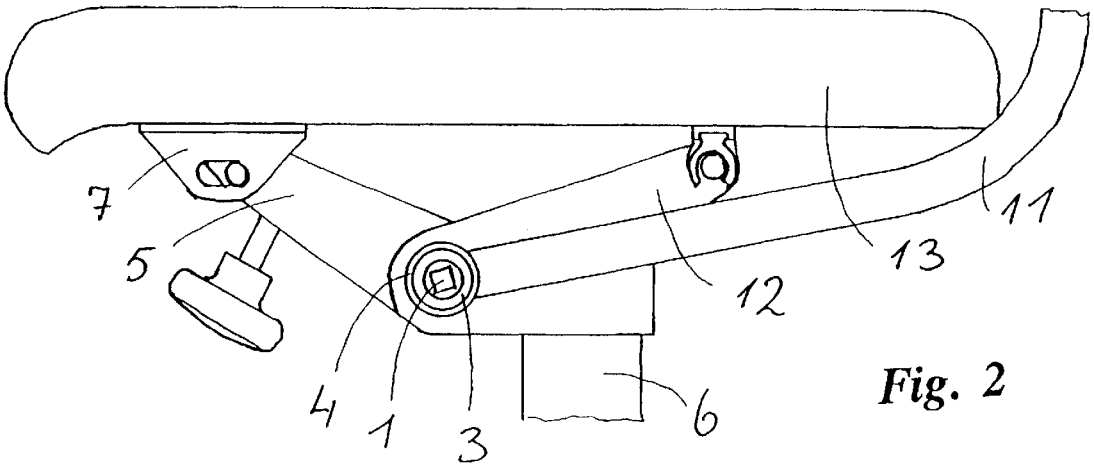
Figure 3:
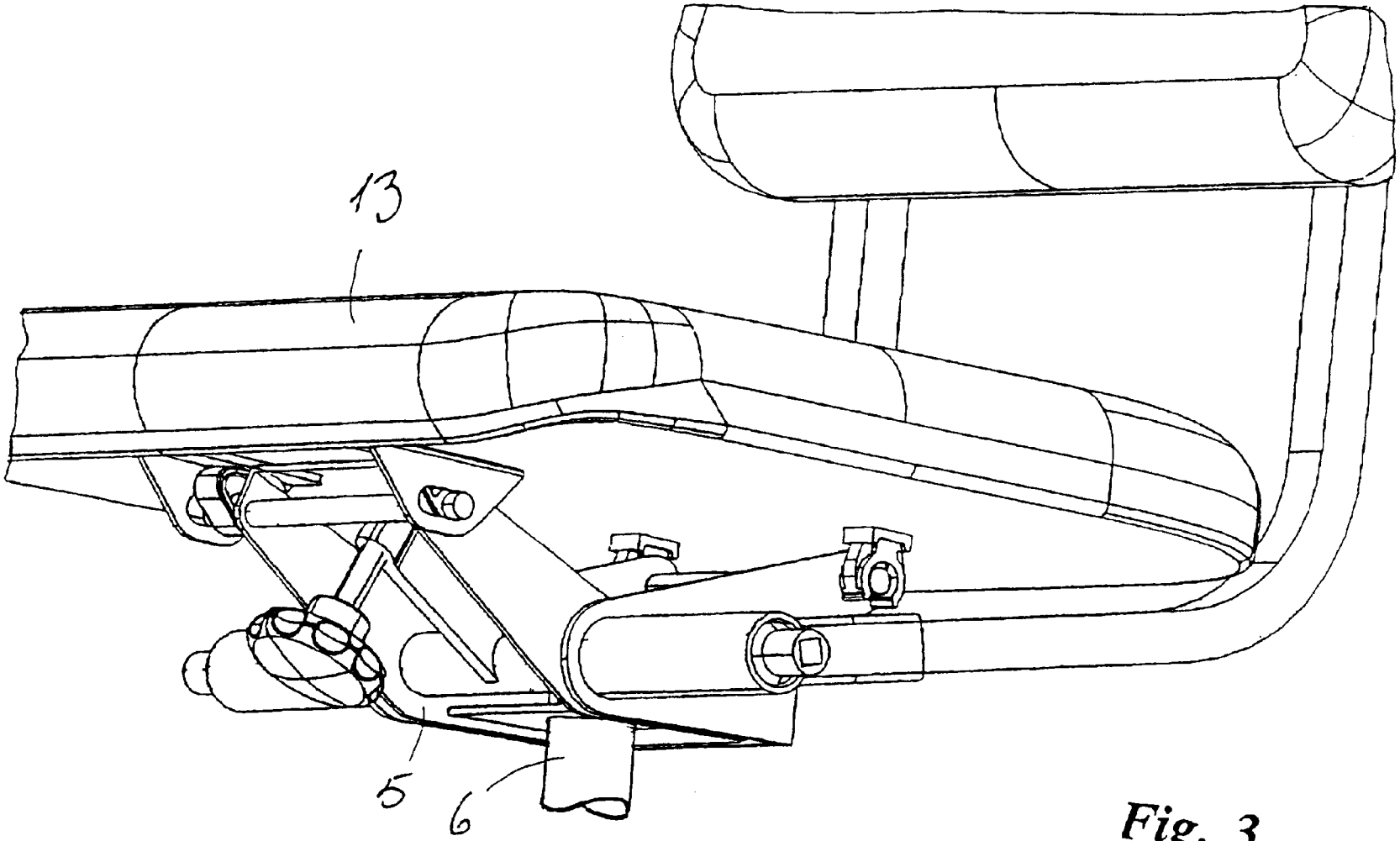

The drawing discloses in FIG. 1 a ground view seen from below and partly in section, of the mechanism according to the invention, FIG. 2 discloses a side view of a seat with the mechanism according to the invention and FIG. 3 discloses a perspective view of the mechanism secured to a chair, as seen from below.

A bow mechanism 5 is connected with the column 6 of the chair or another type of fundament. The mechanism 5 extends forwardly towards the front part of the seat and is here connected displayably with the seat by a plate 7 comprising two flanges. In another embodiment, the mechanism is fixedly connected with the front part of the seat and displayably connected at the rear of the seat. Movement of the back brings the seat to rotate and simultaneously to glide?

Through the bow mechanism 5 an inner pipe 3 extends turnably having one end secured to one end of a torsion spring 1 whereas as a pressure arm 8 is connected with a centre portion of the inner pipe 3 pressing with prestressing against the plate on the bow mechanism 5 with an adjustable screw 9.

The other end of the torsion spring 1 is fixedly connected with a pipe 2 in which the inner pipe 3 is supported. A support 10 for the back is fixedly connected with the pipe 2. At the other end of the torsion spring 1 a pipe 4 encloses the inner pipe 3 whereas a second back support 11 is fixedly connected with the pipe 4. The outer pipe 2 and the pipe 4 are fixedly connected with an angle profile 12 which again is supported turnably to the underside of the seat 13 or to the back supports 10, 11.

With the mechanism according to the present invention a possibility is provided for securement of wide and high backs as are used in arm chairs as well as office chairs. By movement of the back supports 10, 11 a resilient lowering of the back portion of the seat 13 is achieved which again forces a displayment of the seat backwardly as a synchronous movement. In another embodiment the seat is displaced forwardly in cases where the fixed securement to the seat is in the front portion of the seat and the displaceable securement is in the back portion of the seat.

What is claimed is:

1. A chair mechanism which is mounted to an office chair or the like characterized in that a first end of a torsion spring (1) is fixedly connected with one end of an inner pipe (3), said one end of said inner pipe (3) being rotatably supported in a first outer pipe (4), the second end of said torsion spring (1) is fixedly connected with a second outer pipe (2), said first and second outer pipes (4,2) being rigidly connected with each other by a bridging profile (12), thereby securing a rigid connection between the first and second outer pipes (4,2), the bridging profile (12), a seat (13) of the chair and two back supports (10,11) of the chair, said back supports (10,11) being secured at a distance from each other to respectively the first and second outer pipes (4,2), and a pressure arm (8) is connected to a center portion of the inner pipe (3) between the first and second outer pipes (4,2), the pressure arm (8) thereby abutting with a prestress against a support plate (5), the prestress being adjustable by means of a screw (9), the support plate (5) thereby being connected with a fundament column (6) of the chair.

* * * * *